US006142082A

United States Patent [19]

Burke et al.

[11] Patent Number: 6,142,082

[45] Date of Patent: Nov. 7, 2000

[54] GUIDE BRACKET FOR DOORS ON RAILROAD CARS

[76] Inventors: Michael K. Burke, 807 Deerpath Ct., Wheaton; Walter J. Peach, Jr., 1410 Golden Oaks Pkwy., Aurora, both of Ill.

[21] Appl. No.: 09/218,789

[22] Filed: Dec. 22, 1998

[51] Int. Cl.[7] ..... E05D 13/00

[52] U.S. Cl. ..... 105/377.09; 105/378; 49/410

[58] Field of Search ..... 105/331, 332, 105/339, 343, 355, 378, 377.09; 49/409, 410; 16/102, 106, 101, 107, 99

[56] References Cited

U.S. PATENT DOCUMENTS

| | | | |
|---|---|---|---|
| 268,836 | 12/1882 | Stearns | 49/409 |
| 2,897,515 | 8/1959 | Collins . | |
| 3,587,477 | 6/1971 | Ferris . | |
| 3,995,563 | 12/1976 | Blunden . | |
| 4,077,330 | 3/1978 | Peisner . | |
| 4,079,818 | 3/1978 | Chierici . | |
| 4,348,964 | 9/1982 | Randolph . | |
| 4,437,410 | 3/1984 | Stoller . | |
| 4,452,345 | 6/1984 | Mathieu . | |
| 4,476,652 | 10/1984 | Beauchot | 16/99 |
| 4,917,021 | 4/1990 | Murphy . | |
| 5,765,486 | 6/1998 | Black, Jr. et al. . | |

*Primary Examiner*—Mark T. Le
*Attorney, Agent, or Firm*—Bell, Boyd & Lloyd LLC

[57] ABSTRACT

An improved guide bracket for doors on railroad cars which reduces or eliminates wear of the guide bracket and the guide member of the lower door track of the railroad car. The improved guide bracket includes a J-shaped plate and a tubular plastic wear collar or member mounted on the plate. The wear collar engages the inner surface of the guide member of the lower door track and prevents wear of the guide member when the door moves or vibrates. When worn, the wear collar may be separately replaced without replacing the entire J-plate and or track.

19 Claims, 5 Drawing Sheets

GUIDE BRACKET FOR DOORS ON RAILROAD CARS

DESCRIPTION

This invention relates in general to an improved guide bracket for doors on railroad cars, and more particularly to an improved guide bracket which is mounted at the bottom of a door on a railroad car to reduce or eliminate wear on the guide bracket and the vertically disposed guide member of the lower door track which occurs when the door moves or vibrates.

BACKGROUND OF THE INVENTION

The railroad industry employs a variety of railroad cars for transporting products. Many of these cars, such as boxcars or auto rack railroad cars, are enclosed to protect the products or vehicles being transported. The enclosed railroad cars generally include one or more sliding doors to provide access to the interior of the cars. The doors are generally mounted on upper and lower tracks which are attached to the frames of the cars. As described in more detail below in relation to auto rack railroad cars, the guide brackets attached to the lower end of the door and the lower tracks tend to wear out the tracks. Currently, there is no guide bracket for a lower door track which reduces or eliminates this wear on the guide bracket or the tracks.

Auto rack railroad cars which transport newly manufactured vehicles including automobiles, vans and trucks, provide a prime example of this wear problem. Auto rack railroad cars, known in the railroad industry as auto rack cars, often travel thousands of miles through varying terrain. The typical auto rack car is compartmented, having two or three floors, a frame, two side walls, a roof and a pair of doors at each end of the car. The doors protect the auto rack car from illegal or unauthorized entry to prevent theft or vandalism of the vehicles. The doors also prevent flying objects from entering the car and damaging the vehicles. The doors can be unlocked and easily and quickly moved between closed and open positions to provide access to the vehicles in the auto rack car.

Examples of such doors for auto rack cars are generally illustrated in U.S. Pat. Nos. 3,995,563, 4,077,330 and 4,917,021. The bottom of each door includes at least two guide brackets with roller assemblies attached thereto. Each roller assembly includes a roller which engages the horizontally disposed bearing member of the lower door track attached to the frame of the auto rack car to facilitate movement of the door along the track. The guide bracket includes a hook which engages the inner surface of the vertically disposed guide member of the lower door track to prevent the door from falling off the track. The guide bracket and the track are both made of a suitable metal such as steel.

When the door is moved between open and closed position, the hook engages and slides along the inner surface of the guide member, thereby guiding the movement of the door on the track. This metal-on-metal contact causes substantial wear on the inner surface of the guide member and on the guide bracket. Additionally, when the auto rack car is attached to a train, the normal movement of the train on rails along flat surfaces causes the door to vibrate. This vibration causes the hook to continuously engage the inner surface of the guide member and results in further wear on the guide member and on the guide bracket. The wear on the guide member and on the guide bracket is exponentially increased as the auto rack car travels at high speeds and through varying terrain. The bottom of the doors on many auto rack cars also tend to lean outwardly from the frame. This increases the force of the engagement between the hook and the inner surface of the guide member and therefore causes further wear on the guide member and on the guide bracket. On many auto rack cars, the hook wears the guide member razor thin or completely wears out the guide member. In some auto rack cars, the worn guide member creates a pocket in which the hook rests which thereby prevents movement of the door. In such cases, the door must be physically moved inwardly, disengaging the hook from the pocket before moving the door. This makes the door more difficult to open. Although grease may be applied to the guide member to reduce this wear problem, grease is rarely used or correctly applied in the field.

When the guide member is worn sufficiently thin or completely worn out, the door and specifically the rollers may come off the track. Because this presents a potential safety hazard, the guide member or the entire lower door track must be repaired before the guide member is worn away. To replace the guide member or lower door track, the guide member or the entire track must be cut off the frame (i.e., using a torch) and a new guide member or lower door track must be attached (i.e., welded) to the frame of the auto rack car. This repair of the worn guide members on an auto rack car which includes four tracks (i.e., one for each door) is relatively expensive. The worn guide brackets also need to be replaced in some instances. Moreover, revenue may be lost from having the auto rack car out of service to repair the tracks.

U.S. Pat. No. 4,917,021 discloses door finger guides for doors on auto rack cars which guide the upper ends of the doors and prevent wear along the upper door tracks when the doors are opened and closed. However, U.S. Pat. No. 4,917,021 does not suggest any guide bracket or wear member for the lower door track. Further, there is no known commercially available product or other known device or apparatus which prevents the wear problem of the guide bracket and the guide member of the lower door track of auto rack cars, of box cars, or of other enclosed railroad cars.

SUMMARY OF THE INVENTION

The present invention solves the above problems by providing an improved guide bracket which substantially reduces or eliminates the wear on the guide bracket and guide member of the lower door track on railroad cars. The improved guide bracket of the present invention includes a replaceable plastic wear collar or member which, when worn out, may be replaced with a new wear collar or member without the need to replace the entire guide bracket. The improved guide bracket does not interfere with the movement of the door, allows the door to roll easier along the lower door track, and can be easily and quickly installed on the door to replace the current guide bracket. This present invention thereby provides a relatively inexpensive solution to the wear problem of the guide member of the lower door track and guide bracket, eliminates the need for the relatively expensive repairs of the lower door track, improves movement of the door, and reduces the time the railroad cars are out of service for repairs.

The improved guide bracket of the present invention includes a steel J-shaped plate and a replaceable plastic wear collar or member. The J-shaped plate includes inner and outer walls connected by a U-shaped bight portion. The outer wall is adapted to be attached to the door. The inner wall includes a base which defines an upper shoulder on which the wear collar rests and a neck of a smaller dimension than the base. The neck extends upwardly from the base. The neck is of a suitable or limited height so as not to interfere with the bottom surface of the lower door track including any, supporting members or gussets. The neck includes a locking notch for maintaining the wear collar on the J-shaped plate. The wear collar is preferably extruded from an ultra-high molecular weight polyethylene. The wear collar includes an engaging wall which contacts the guide member and locking walls which maintain the engaging wall on the neck. For auto rack cars which include a curved guide member, the wear collar preferably includes curved or convex spaced-apart side walls integrally connected by spaced-apart end walls. The outer surface of the walls define an oval-shaped substantially symmetrical tubular body and the inner surface of the walls define a centrally located oval-shaped slot. The width of the slot is slightly greater than the width of the neck, and the length of the slot is slightly greater than the length of the neck to allow the wear collar to be mounted on the neck. The engaging wall consists of the side wall which contacts the inner surface of the guide member. The opposite side wall and the two end walls act as the locking walls. The curved or convex shape of the engaging wall of the wear collar reduces the friction between the wear collar and the curved guide member as the door opens or closes. A suitable roller assembly is connected to the J-shaped plate and engages the bearing member of the lower door track to support the door.

For box cars or other cars with straight lower door tracks, the side walls and the end walls of the wear collar may define a rectangular-shaped substantially symmetrical tubular body with a substantially flat wear collar engaging wall which engages the substantially straight guide member.

The wear collar or member of the improved guide bracket of the present invention does not extend above the height of the neck and will not interfere with the lower door track, supports or gussets therefore. Further, the wear collar is preferably symmetrical in all three dimensions (i.e. along its length, width and height) which facilitates mounting the wear collar on the plastic neck with either side wall acting as the engaging wall contacting the inner surface guide of the member and with either end facing upwardly. This prevents the wear member from being incorrectly mounted on the neck of the J-shaped plate. This also allows the wear collar may be reversed when the engaging wall is worn.

The present invention also includes alternatively configured guide brackets adapted to be mounted on the right hand side of the left hand door and on the left hand side of the right hand door to avoid engaging the sockets or barrels which receive the pins which hold the bridge plates between the cars.

It is therefore an object of the present invention to provide an improved guide bracket for doors on railroad cars which reduce or eliminate the wear on the guide bracket and on the guide member of the lower door track.

Another object of the present invention is to provide an improved guide bracket for doors on railroad cars which includes a J-shaped plate and a wear collar which can be replaced without the need to replace the entire J-shaped plate.

A further object of the present invention is to provide an improved guide bracket which reduces wear on the guide member, does not interfere with the movement of the door, and makes the door easier to move.

A still further object of the present invention is to provide an improved guide bracket which reduces wear on the guide member and which is easily and quickly installed on the door a railroad car.

An even further object of the present invention is to provide an improved guide bracket which reduces wear on the guide member and eliminates pockets formed in the guide member, thereby making the door easier to move.

A yet further object of the present invention is to provide an improved guide bracket which reduces wear on the guide member and does not interfere with the sockets or barrels for the pins of the bridge plates.

Other objects, features and advantages of the present invention will be apparent from the following detailed disclosure, taken in conjunction with the accompanying sheets of drawings, wherein like reference numerals refer to like parts.

DESCRIPTION OF THE PREFERRED EMBODIMENT

Figure 2:
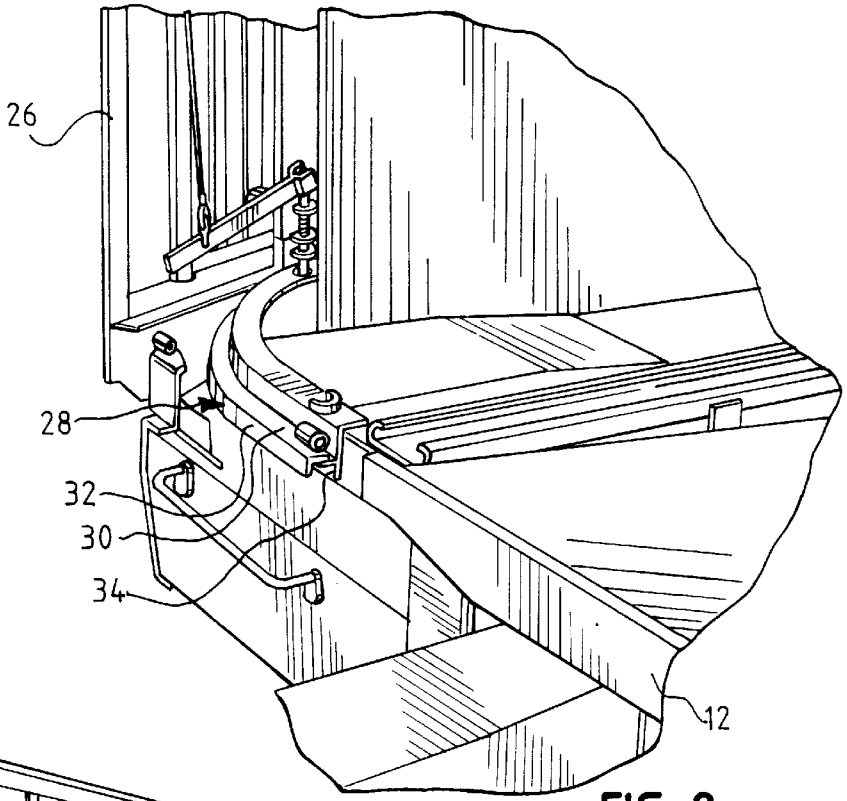
FIG. 2 is a fragmentary perspective view of the end of an auto rack car, the left hand door and the lower door track for the left hand door.

The improved guide bracket of the present invention is suitable for reducing or eliminating wear on the guide brackets and the lower door tracks for enclosed railroad cars. The improved guide bracket of the present invention is described in detail below in relation to auto rack cars, although the present invention is also suited for box cars and other enclosed railroad cars.

Referring now to the drawings, and particularly to FIGS. 1 to 4, a typical auto rack car 10 includes a frame 12 supported by trucks 14, each of which have several wheels 16 which roll along railroad tracks 18. The frame 12 supports two side walls or panels 20 and a roof 22. The auto rack car 10 includes a pair of coacting clamshell doors 24 and 26 mounted on each end of the car. These doors are opened to facilitate the loading and unloading of vehicles into and out of the auto rack car. The right hand door 24 and the left hand door 26 (when viewed from the outside of the car) are shown in closed position in FIG. 1, and the left hand door 26 is shown in open position in FIG. 2 and in closed position in FIG. 4.

Figure 3:
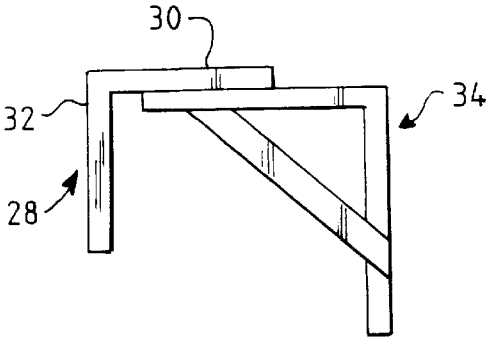
FIG. 3 is enlarged end view of a lower door track on an auto rack car.
Figure 1:
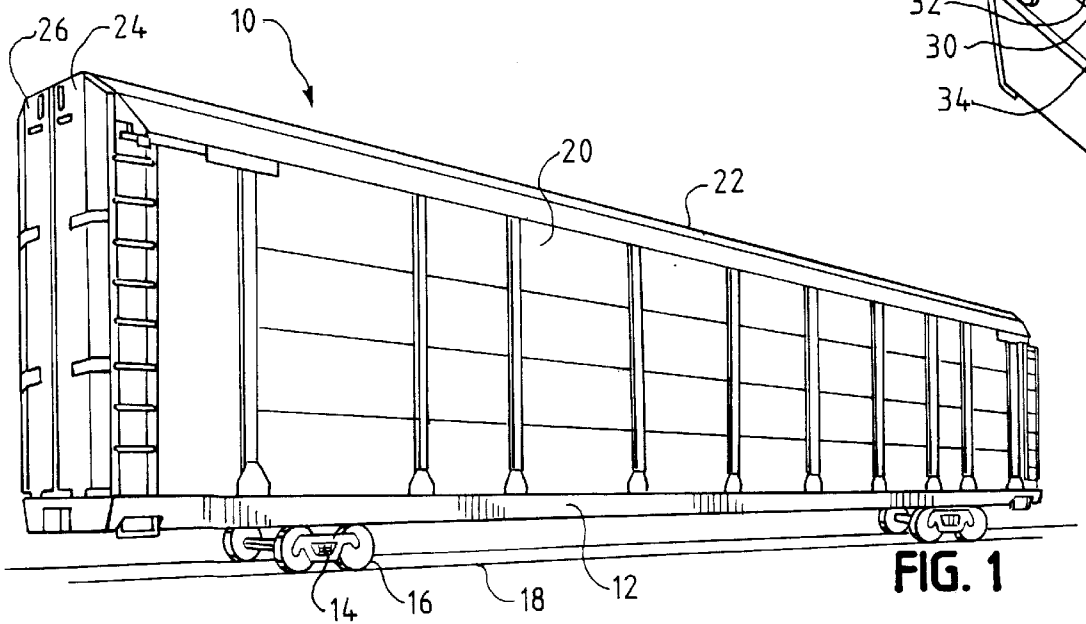
FIG. 1 is a perspective view of an auto rack railroad car illustrating the right and left hand doors at one end of the car.

The doors 24 and 26 are supported and guided at their bottom ends by lower door tracks or rails 28 mounted on the frame 12 and are guided at their upper ends by upper door tracks or rails (not shown). While only the lower door track 28 for the left-hand door 26 is shown, it should be appreciated that a corresponding lower door track for the right-hand door is mounted on the frame on the right hand side of the car for supporting and guiding the right hand door 24. The track 28 which is made of a suitable metal such as steel includes a substantially horizontally disposed bearing member 30 and a substantially vertically disposed guide member 32 integrally formed with the outer edge of the bearing member 30. The bearing member is welded to an L-shaped support 34 which is welded to the frame 12. In some auto rack cars, an additional metal (hardened steel) wear plate (not shown) is mounted on top of the upper surface of the bearing member to reduce the wear on the bearing member due to wheel or roller contact and vibration. One or more angled supports or gussets 29 may further support the lower door track 28 as illustrated in FIG. 3.

Figure 4:
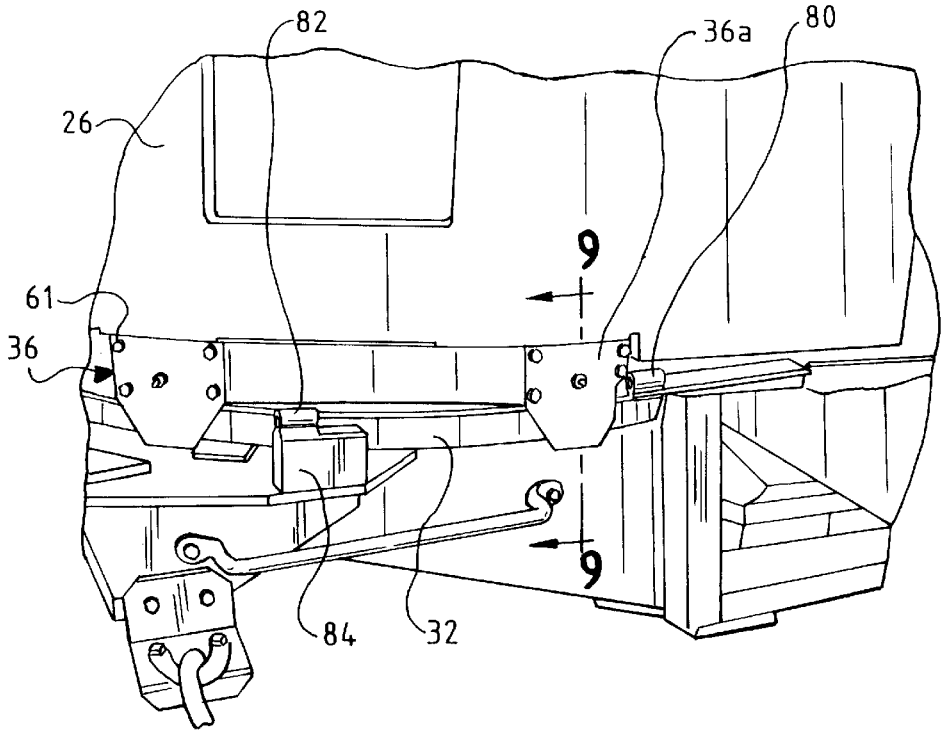
FIG. 4 a fragmentary perspective view of the end of an auto rack car and the improved guide brackets of the present invention mounted on the bottom of the left hand door.

Referring now to FIGS. 4 to 10, the improved guide bracket of the present invention, generally designated by numeral 36, preferably includes a steel J-shaped plate 38 and a plastic wear collar or member 40. More particularly, as illustrated in FIG. 4, the plate 38 is adapted to be mounted near the left side of the bottom of the left hand door 26. A roller assembly 42 is connected to the plate 38 and engages the bearing member 30 of the lower door track 28 to support the door 26. The roller assembly 42 includes a roller 44 of suitable material which runs on the curved and straight portions of the track 28 during movement of the door 26 between open and closed positions. The roller 44 is mounted on a bearing 46 which is journalized around a cylinder or roller shaft 48 which is suitably held in place in the plate 38 and in a U-shaped roller bracket 50 attached to the door in a conventional manner.

Figure 5:
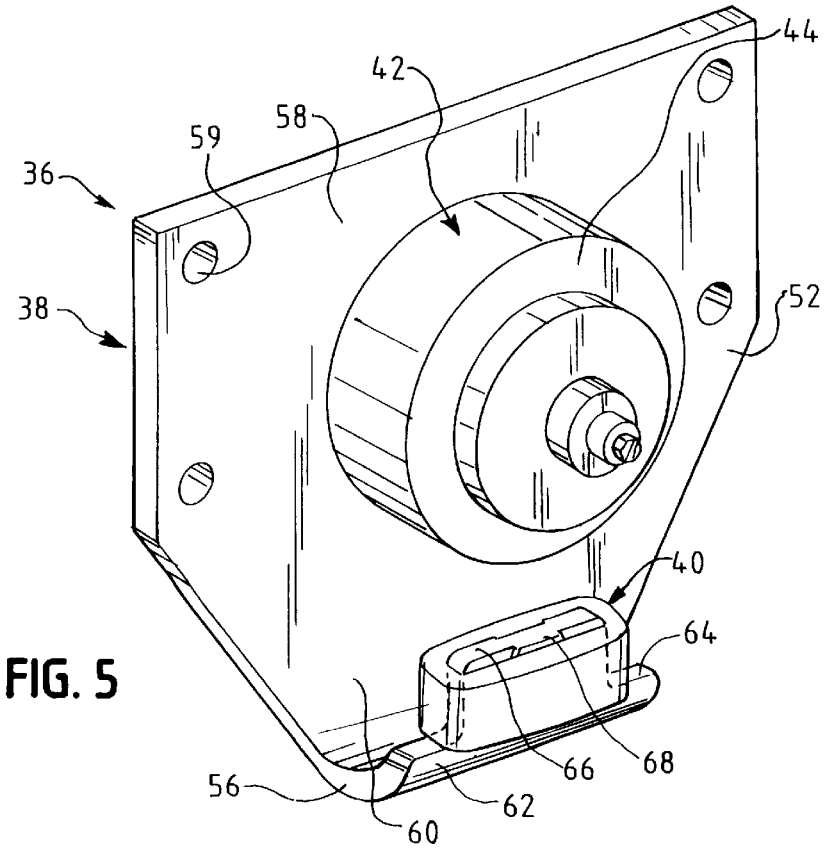
FIG. 5 is a perspective view of the improved guide bracket of the present invention illustrating the J-shaped plate and the replaceable wear collar or member mounted on the plate.
Figure 7:
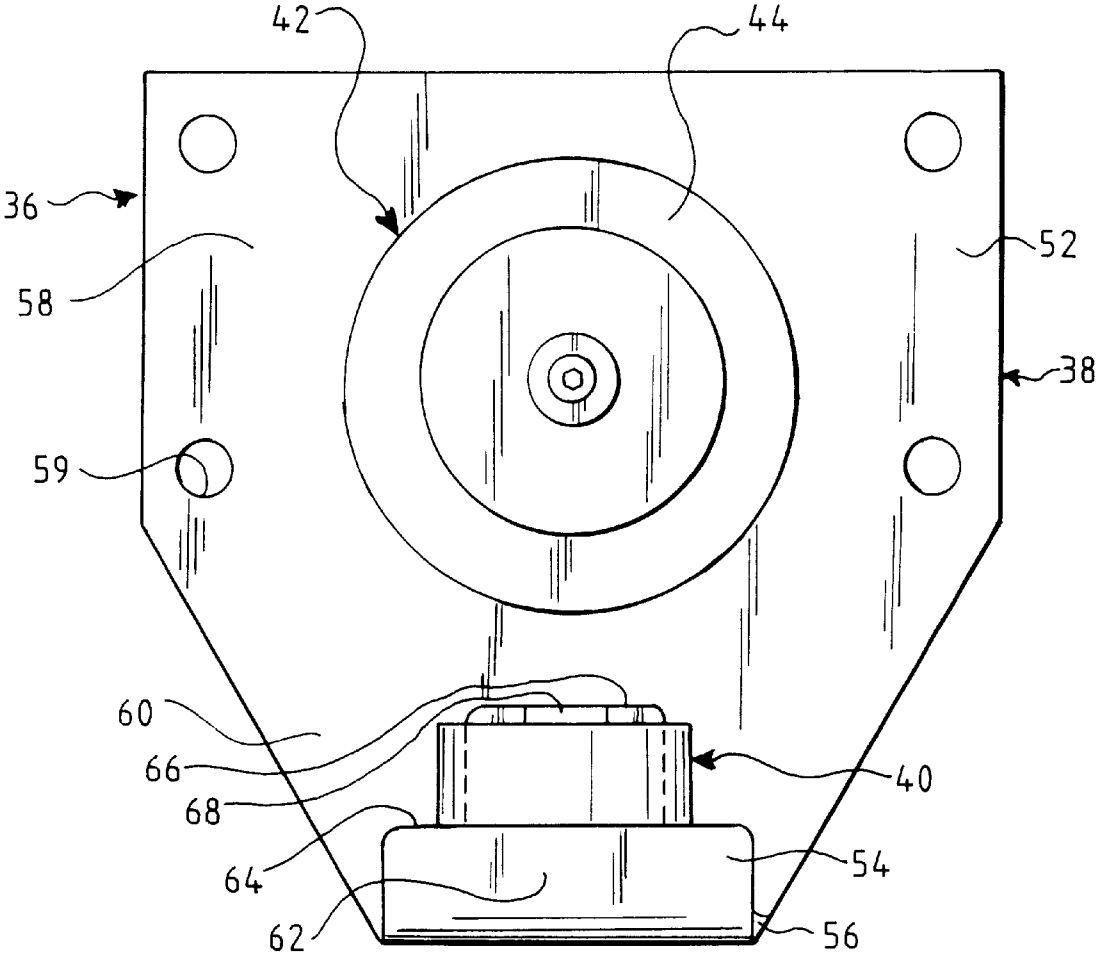
FIG. 7 is a front plan view of the improved guide bracket of the present invention illustrating the J-shaped plate and the replaceable wear collar or member mounted on the plate.
Figure 6:
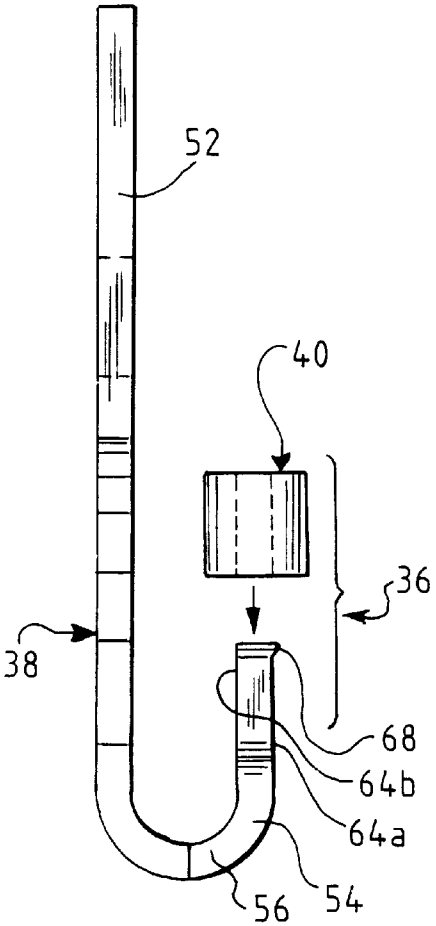
FIG. 6 is an exploded side view of the improved guide bracket of the present invention illustrating the J-shaped plate and the replaceable wear collar or member.
Figure 8:
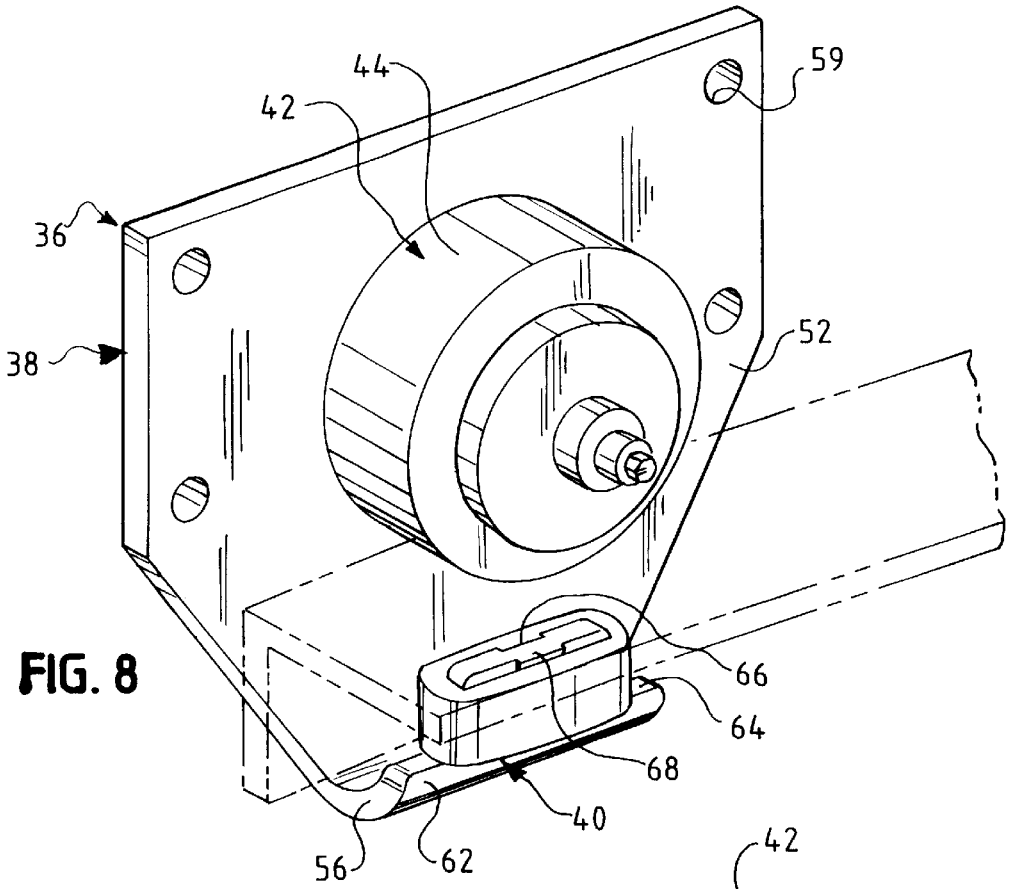
FIG. 8 is a perspective view of the improved guide bracket illustrated in relation to the bearing member and the guide member of the lower door track which are shown in phantom.

The J-shaped plate 38 includes a substantially flat outer wall or member 52 and a substantially flat inner wall or member 54 connected by a U-shaped bight portion or member 56 as illustrated in FIGS. 5, 6 and 7. The outer wall 52 has a substantially rectangular section 58 and a substantially trapezoidal section 60 integrally formed with and extending downwardly from the rectangular section 58. The rectangular section 58 includes four through holes 59 for the bolts 61 which secure the J-shaped plate 38 and the entire improved guide bracket 36 to the door 26 in a conventional manner. The rectangular section 58 also includes a substantially centrally located through hole (not shown) for the bolt roller shaft 48 of the roller assembly 42. The inner wall 54 includes a substantially rectangular base 62 which defines an upper shoulder 64 on which the wear collar 40 rests and a substantially rectangular neck 66 extending upwardly from the base 62 on which the wear collar 40 is maintained. The neck 66 is of a smaller length than the base 62.

The neck 66 includes a locking notch 68 on the surface 64*a* facing the frame of the auto rack car and an indentation 69 in the surface 64*b* facing the door. The locking notch 68 extends horizontally along the central portion of the upper edge of the neck 66 and slightly extends laterally from the neck. The locking notch 68 prevents the upward movement of the wear collar on the neck which may be caused by continuous vibration of the door and guide bracket during movement of the auto rack car and thus maintains the wear collar 40 on the J-shaped plate 38. The locking notch 68 may alternatively be found on surface 64*b* of the neck 66, the side edges of the neck or any combination thereof and may be a different suitable shape or size. The neck 66 must be of a limited height so as not to interfere with the bottom surface of the bearing member 30, the L-shaped support 34, or the gussets which extend at intervals below the bearing member to support the lower door track 28. The corners of the neck and the base are preferably rounded to avoid injury and to eliminate stress risers which could occur in sharp corners and result in cracks in the guide bracket.

The J-shaped plate 38 is preferably made of a suitable metal such as steel, although it could be made of other suitable materials such as plastics, ceramics or composites. To form the steel J-shaped plate, a suitably sized blank steel plate is laser cut, burned or die cut to the desired profile for the outer wall, the inner wall and the bight portion. The appropriate holes are punched at the desired locations in the plate. The progressive dies form the locking notch by indenting or deforming the upper edge of the neck. The locking notch may alternatively be formed by welding a suitable bead or small washer or tab to the top of the neck or in any other suitable manner. Thereafter, the blank plate is bent in a convention manner using progressive dies to form the outer wall 52, the inner wall 54 and the bight portion 56. Prior to installation, the J-shaped plate is preferably primed and painted with a suitable rust preventing primer and paint. It should be appreciated that the J-shaped plate of the improved guide bracket of the present invention could be formed in any suitable alternative manner and could be formed of an alternative shape corresponding to the shape of the door.

Figure 10:
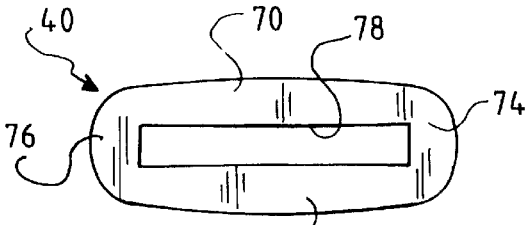
FIG. 10 is a top plan view of the wear collar or member of the guide bracket of the present invention.

The wear collar or member 40 of the improved guide bracket 36 includes an engaging wall 70 which is secured on the neck by locking walls 70, 74 and 76. The wear collars thereby preferably includes opposed spaced-apart side walls 70 and 72 integrally connected by opposed spaced-apart end walls 74 and 76. The walls define an oval-shaped substantially symmetrical tubular body and the inner surface of the walls define a substantially centrally located oval-shaped slot 78. The width of the slot 78 is slightly greater than the width of the neck, and the length of the slot 78 is slightly greater than the length of the neck to allow the wear collar to be mounted over the neck. The height of the walls of the wear collar is smaller than the height of the neck. The side wall or engaging wall 70 is secured on the neck by the locking walls which include the opposite side wall 72 and the end walls 74 and 76. As best illustrated in FIG. 10, the outer surface of the side (either one of which can function as the engaging wall) walls have a curved or convex shape to coincide with the curvature of the track and thereby to reduce the friction between the wear collar and the curved guide member as the door opens or closes, whereby the engaging wall facing the guide member engages the inner surface of guide member.

The wear collar or member 40 may be made of any suitable material having a low coefficient of friction to steel, dry self-lubricating and non-hydroscopic characteristics, a high compressive strength and a high resistance to wear. The wear collar or member is preferably a linear high-density polyethylene which is usually referred to as an ultra-high molecular weight polyethylene which is generally available on the market. The wear collar or member is preferably manufactured in long lengths using a conventional extrusion die process and cut to the desired height. The symmetrical shape of the wear collar simplifies the extrusion process, although it should be appreciated that the wear collar could be non-symmetrical. The wear collar of the present invention could be formed from alternative methods such as injection molding, could be any color desired and may be made from other types of material such as a high density polypropylene, a suitable nylon material or any similar material. Although it is usually protected from direct sunlight by the lower door track, the wear collar could also include an ultraviolet inhibitor.

Alternatively, for railroad box cars and other railroad cars with straight lower door tracks and flat guide members, the wear collar or member of the improved guide bracket of the present invention may include opposed spaced-apart side walls integrally connected by opposed spaced-apart end walls which defined a rectangular substantially symmetrical tubular body. The inner surface of the walls may define a centrally located rectangular or oval-shaped slot. The width of the slot is slightly greater than the width of the neck, and the length of the slot is slightly greater than the length of the neck to allow the wear collar to be mounted over the neck. The height of the walls of the wear collar is smaller than the height of the neck. The engaging wall is secured on the neck by the locking walls which preferably include the side wall opposite the engaging wall and the end walls. The flat engaging wall will thereby coincide with the flat guide member.

Figure 9:
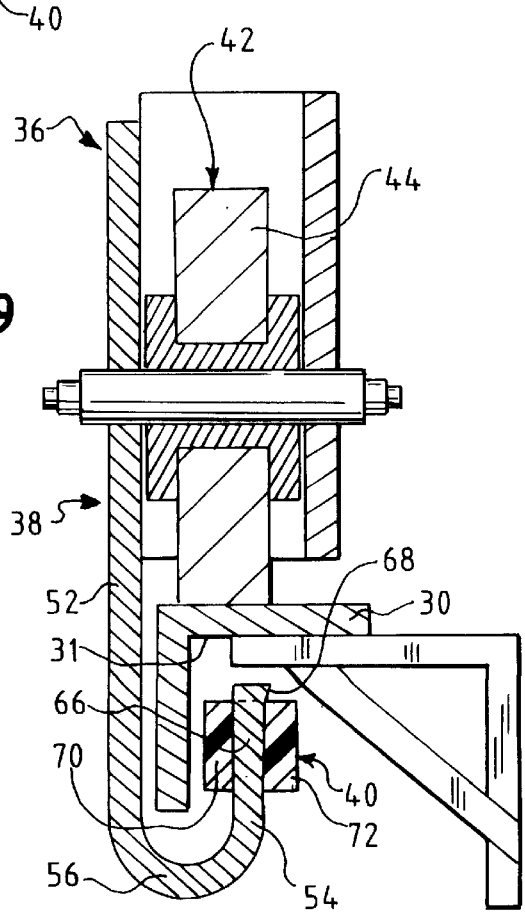
FIG. 9 is a cross-sectional view of the improved guide bracket in relation to the bearing member and guide member of the lower door track taken substantially through line 9—9 of FIG. 4.

Referring back to auto rack railroad car, as illustrated in FIG. 9, sufficient clearance is necessary between the neck 66 and wear collar 40 and the bottom surface 31 of the bearing member 30 of the lower door track 28 (and the L-shaped support or gussets extending below the bottom surface of the bearing member) to provide uninterrupted movement of the door. Sufficient clearance is also needed because the doors tend to balance on one roller and tend to rock from side-to-side. Accordingly, the wear collar 40 of the improved guide bracket 36 of the present invention does not extend above the height of the neck and will not interfere with the lower door track.

The wear collar 40 is preferably symmetrical in all three dimensions (i.e. along its length, width and height). This configuration facilitates mounting the wear collar on the neck with either side wall acting as the engaging wall contacting the inner surface of the guide member and with either end facing upwardly. In the field, when the wear collar is originally installed or replaced, the wear collar thus cannot be incorrectly mounted on the neck. Although the wear collar is preferably replaced when the engaging wall of the wear collar is worn, it is possible in some instances because the wear collar is synmmetrical to reverse the wear member such that the worn engaging wall faces away from the guide member and the opposite side wall then becomes the engaging wall.

The improved guide bracket 36 of the present invention may be installed on the doors of the auto rack car by removing the old bracket and attaching the improved guide bracket in the same position as the old bracket. Prior to installation, the wear collar 40 is mounted on the J-shaped plate 38 by aligning the wear collar over the neck 66 and pushing the wear collar over the locking notch 68 and onto the neck 66. The walls of the wear collar are adapted to slightly flex outwardly when forced over the locking notch 66.

As illustrated in FIG. 9, the wear collar 40 mounted on the neck 66, which are both aligned with guide member, engages the inner surface of the guide member to guide the movement of the lower part of the door and to maintain the roller on the track, thereby preventing the door from coming off of the track. Whether the door is in the closed or open position, any vibration in the door will also cause the engaging wall of the wear member to engage the inner surface of the guide member, and the wear collar 40 thereby further prevents wear of the guide member on the J-shaped plate 38. Likewise, when the bottom of the door leans outwardly, the wear collar 40 will engage the inner surface of the guide member and also prevent wear on the guide member and J-shaped plate 38.

When the wear collar or member is sufficiently worn or completely worn out, the bracket may be removed from the door, and the wear collar may be pried off the neck by forcing it over the locking notch. The wear collar may also be cut off of the neck. A new wear collar or member may be inserted on the neck of the guide bracket and the bracket may be reinstalled on the door. This reconstruction of the improved guide bracket is substantially quicker, easier and less expensive than the reconstruction of the guide member or the lower door track. The worn wear collar may be recycled.

When loading or unloading an auto rack car, vehicles are often driven from one auto rack car to an adjacent auto rack car to facilitate efficient loading and unloading of the vehicles. A bridge plate (not shown) is normally used to connect adjacent auto rack cars. The bridge plates are secured to the auto rack cars by pins (not shown) suitably connected to the sockets or barrels 80 and 82, as shown in FIGS. 2 and 4. Socket or barrel 80 is mounted on the bearing member 30 and socket or barrel 82 is attached on a mounting bracket 84 which is connected to the frame 22. When the door is closed, the guide bracket must avoid any contact with socket or barrel 80.

Figure 11:
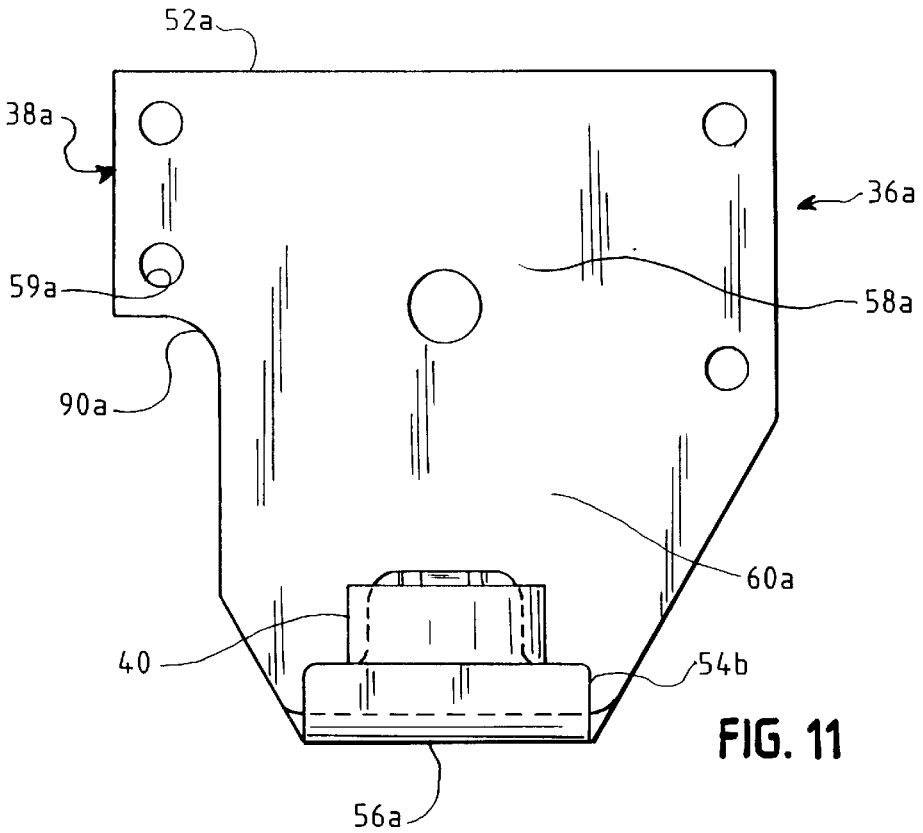
FIG. 11 is a plan view of the improved left hand guide bracket for the left hand door of an auto rack car.
Figure 12:
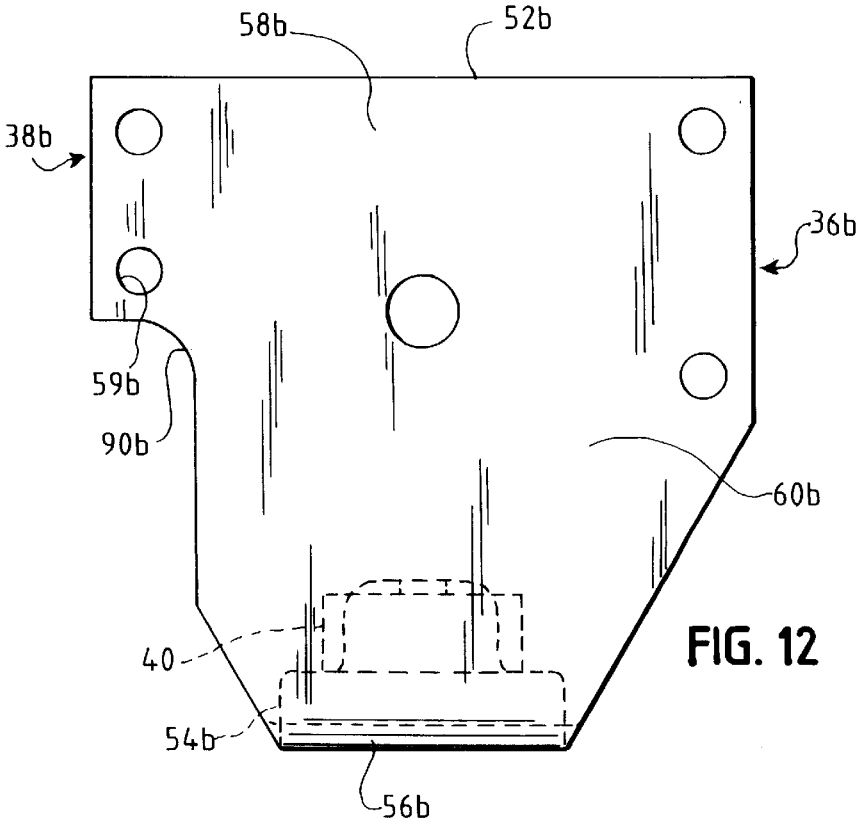
FIG. 12 is a plan view of the improved right hand guide bracket for the right hand door of an auto rack car.

Accordingly, the present invention includes alternatively configured guide brackets, generally designated by numerals 36*a* and 36*b*, as illustrated in FIGS. 4, 11 and 12. The improved guide bracket 36*a* as illustrated in FIG. 11 is adapted to be mounted on the right hand side of the left hand door and the improved guide bracket 36*b* as illustrated in FIG. 12 is adapted to be mounted on the left hand side of the right hand door 24. Similar to improved guide bracket 36, guide brackets 36*a* and 36*b* include J-shaped plates 38*a* and 38*b* and identical oval-shaped tubular wear collars or members 40. The J-shaped plates 38*a* and 38*b* include substantially flat outer walls 52*a* and 52*b* and substantially flat inner walls 54*a* and 54*b* connected by U-shaped bight portions or walls 56*a* and 56*b*. The outer walls 52*a* and 52*b* include curved walls 90*a* and 90*b*, respectively, in the substantially rectangular sections 58*a* and 58*b* and the substantially trapezoidal sections 60*a* and 60*b*. The curved walls prevent the brackets from engaging or interfering with the sockets. The through holes 59*a* and 59*b* are also provided in suitable positions.

It will be understood that modifications and variations may be effected without departing from the scope of the novel concepts of the present invention, and it is understood that this application is to be limited only by the scope of the appended claims.

The invention is hereby claimed as follows:

1. A guide bracket for a door on a railroad car, said railroad car having a flame and a lower door track connected to the frame, said track having a substantially horizontally disposed bearing member for supporting the door and a substantially vertically disposed guide member having an inner surface engaged by said guide bracket for guiding the movement of the door on the track and preventing the door from coming off the track, said guide bracket comprising:

a plate having connected inner and outer walls, said outer wall adapted to be attached to said door, and said inner wall adapted to be aligned with said guide member; and a plastic wear member attached to the inner wall and aligned with said guide member, whereby the wear member adapted to engage the inner surface of the guide member when the door moves or vibrates to reduce wear on the guide member.

2. The guide bracket of claim 1, wherein the inner wall includes means for maintaining the wear member on the inner wall.

3. The guide bracket of claim 2, wherein the maintaining means includes a locking notch.

4. The guide bracket of claim 1, wherein the inner wall includes a base defining a shoulder and a neck extending upwardly from said base.

5. The guide bracket of claim 4, wherein the neck includes a locking notch laterally extending from a surface of the neck.

6. The guide bracket of claim 1, wherein the wear member includes an engaging wall and at least two locking walls.

7. The guide bracket of claim 6, wherein the wear member includes spaced-apart side walls integrally connected by spaced-apart end walls which define a tubular body with a substantially centrally located slot, whereby one of said side walls is the engaging wall and the opposite side wall and end walls are the locking walls.

8. The guide bracket of claim 7, wherein the wear member is substantially symmetrical in at least one dimension.

9. The guide bracket of claim 7, wherein the wear member is substantially symmetrical in at least two dimensions.

10. The guide bracket of claim 7, wherein the guide member is curved and the engaging wall is convex.

11. The guide bracket of claim 7, wherein the guide member is straight and the engaging wall is substantially flat.

12. The guide bracket of claim 10, wherein the wear member is substantially oval.

13. The guide bracket of claim 7, wherein the wear member is substantially rectangular.

14. The guide bracket of claim 1, wherein the wear member is made from a dry, self-lubricating material having a relatively high compressive strength and high resistance to wear.

15. The guide bracket of claim 14, wherein the wear member is extruded from an ultra-high molecular weight polyethylene.

16. A guide bracket for a door on a railroad car, said guide bracket adapted to be mounted adjacent to a lower end of the door to guide the lower end of the door along a lower door track attached to the car during opening and closing of the door, said track including a substantially vertically extending guide member, said guide bracket comprising:

an outer wall adapted to be mounted on the door;

an inner wall adapted to be aligned with the guide member, said inner wall including a base which defines a shoulder, and a neck extending from the base and having a smaller dimension than the base; and a plastic wear collar mounted on the neck and supported by the shoulder, said wear collar including an engaging wall adapted to be aligned with and to engage the guide member to reduce the wear on the guide member as the door moves or vibrates, and said wear collar including at least two locking walls connected to the engaging wall and adapted to maintain the wear collar on the neck.

17. In a car having a frame, a lower door track connected to the frame, and a door movably mounted on said lower door track, said lower door track having a substantially horizontally disposed bearing member for supporting the door and a substantially vertically disposed guide member for guiding the movement of the door, a guide bracket mounted on the door for engaging the guide member along its inner surface to guide the door and to prevent the door from disengaging the lower door track, the improvement being in the guide bracket which comprises:

a plate having connected inner and outer walls, said outer wall adapted to be attached to said door, said inner wall adapted to be aligned with said guide member, and a plastic wear collar attached to the inner wall and aligned with said guide member.

18. The guide bracket of claim 17, wherein said inner wall includes a base defining a shoulder and a neck upwardly extending from said base, and said wear collar is mounted on said neck.

19. The guide bracket of claim 18, wherein said wear collar includes an engaging wall which contacts the inner surface of the guide member to reduce wear on the guide member.

* * * * *

UNITED STATES PATENT AND TRADEMARK OFFICE

CERTIFICATE OF CORRECTION

PATENT NO. : 6,142,082
DATED : November 7, 2000
INVENTOR(S) : Michael K. Burke and Walter J. Peach, Jr.

It is certified that error appears in the above-identified patent and that said Letters Patent is Column 3,
Line 4, change "any, supporting" to -- any supporting --.
Line 37, change "i.e. along" to -- i.e., along --.
Line 44, change "collar may be" to -- collar to be --.
Line 67, change "door a railroad" to -- door of a railroad --.

Column 4,
Line 22, change "FIG. 3 is enlarged" to -- FIG. 3 is an enlarged --.
Line 24, change "FIG. 4 a fragmentary" to -- FIG. 4 is a fragmentary --.

Column 6,
Line 28, change "convention manner" to -- conventional manner --.
Line 39, change "wear collars thereby" to -- wear collar thereby --.

Column 7,
Line 18, change "which defined a" to -- which define a --.
Line 43, change "i.e., along" to -- i.e., along --.
Line 52, change "synmmetrical" to -- symmetrical --.

Column 8,
Line 15, change "pried off the" to -- pried off of the --.

Column 8, claim 1,
Line 63, change "having a flame" to -- having a frame --.

Column 9, claim 1,
Line 8, change "member adapted" to -- member is adapted --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*